US007013687B2

(12) United States Patent
Shedd et al.

(10) Patent No.: US 7,013,687 B2
(45) Date of Patent: Mar. 21, 2006

(54) SLIDING DOOR LOCK WITH SINGLE LOCK-RELEASE AND DOOR-OPENING MOTION

(75) Inventors: Nathaniel Segismundo Shedd, Calgary (CA); Darren R. Long, Calgary (CA); James Robert Thompson Goodchild, Calgary (CA)

(73) Assignee: Haworth, Ltd., Calgary (CA)

( * ) Notice: Subject to any disclaimer, the term of this patent is extended or adjusted under 35 U.S.C. 154(b) by 0 days.

(21) Appl. No.: 10/424,260

(22) Filed: Apr. 28, 2003

(65) Prior Publication Data

US 2003/0226384 A1 Dec. 11, 2003

Related U.S. Application Data

(60) Provisional application No. 60/376,593, filed on Apr. 30, 2002.

(51) Int. Cl.
*E05B 65/08* (2006.01)

(52) U.S. Cl. ..... 70/99; 70/97; 70/100

(58) Field of Classification Search ..... 70/208, 70/107, 95–100, 114–116; 292/3, 32–34, 292/37, 156, 159, DIG. 21, DIG. 36
See application file for complete search history.

(56) References Cited

U.S. PATENT DOCUMENTS 416,312 A * 12/1889 Winchester ..... 70/99
720,349 A * 2/1903 Howard et al. ..... 70/97
2,570,160 A * 10/1951 Schoch ..... 70/208
2,666,319 A * 1/1954 Price ..... 70/97
2,723,148 A * 11/1955 Johnson, Jr. ..... 70/97
2,764,439 A * 9/1956 Mansfield ..... 70/95
2,844,020 A * 7/1958 Chittum et al. ..... 70/97
3,012,430 A * 12/1961 Spork ..... 70/99
3,670,537 A * 6/1972 Horgan, Jr. ..... 70/120
3,953,061 A * 4/1976 Hansen et al. ..... 292/5
4,142,747 A * 3/1979 Beck et al. ..... 292/37
4,182,144 A * 1/1980 Leivenzon et al. ..... 70/100
4,457,146 A * 7/1984 Weinerman ..... 70/100
4,480,451 A * 11/1984 Fujiya ..... 70/92
4,563,885 A * 1/1986 Madden ..... 70/97
4,643,005 A * 2/1987 Logas ..... 70/95
4,973,091 A * 11/1990 Paulson et al. ..... 292/16
5,092,144 A * 3/1992 Fleming et al. ..... 70/95
6,519,984 B1 * 2/2003 Morris ..... 70/210

FOREIGN PATENT DOCUMENTS

DE 3633853 A1 * 4/1988
DE 3844320 A1 * 9/1989
FR 2595401 A1 * 9/1987

* cited by examiner

*Primary Examiner*—Brian E. Glessner
*Assistant Examiner*—Christopher Boswell
(74) *Attorney, Agent, or Firm*—Flynn, Thiel, Boutell & Tanis, P.C.

(57) ABSTRACT

A sliding door having an improved handle and lock assembly associated therewith. The assembly enables a closed and locked sliding door to be unlocked and opened by manual application of a single-motion to the door handle, such as a substantially horizontally-directed force applied to the door handle in the opening direction to effect unlocking of the door followed by movement of the sliding door into an open position.

21 Claims, 7 Drawing Sheets

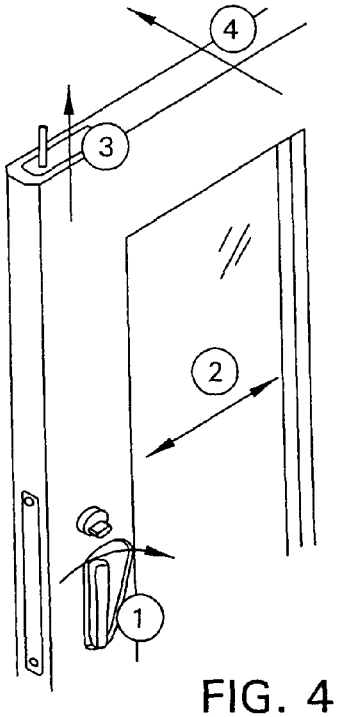

FIG. 4

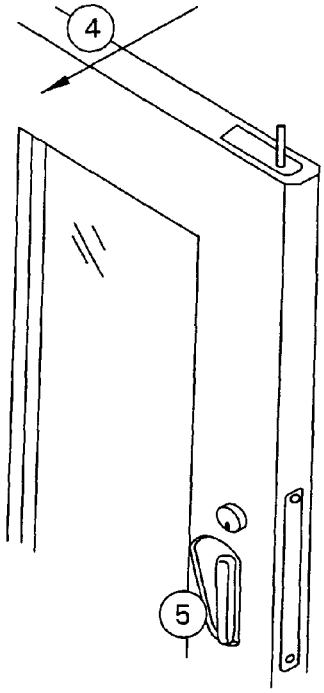

FIG. 5

NOTES:

1. Private office side. Handle with turn cylinder. Path of Egress handle must have locking priority.

2. Operation of door.

3. Threshold bolt locks into either top track or strike on finished floor. Either bolt or strike to be spring loaded.

4. Path of Egress

5. Corridor side. Handle and key cylinder.

"Continuous" pull handle to visually suggest sliding operation, and must not visually suggest swinging or push/pull motion. Handles to have 30-45 degree operation to activate threshold bolt. Optional escutcheon can be recessed or proud. Non-handed door milling preferred.

SLIDING DOOR LOCK WITH SINGLE LOCK-RELEASE AND DOOR-OPENING MOTION

CROSS REFERENCE TO RELATED APPLICATION

This application claims priority under 35 USC §119(e) of copending provisional application Ser. No. 60/376,593 filed Apr. 30, 2002, the entire disclosure of which is herein incorporated by reference.

FIELD OF THE INVENTION

This invention relates to a sliding door having a handle-lock assembly associated therewith and, more specifically, to an improved handle-lock assembly which enables the sliding door to be both unlocked and slidably moved into an open position by application of a manually-applied single-directed force or motion to the handle.

BACKGROUND OF THE INVENTION

Sliding doors supported solely for substantially horizontal sliding movement are conventionally utilized within the interior of commercial buildings, such as office buildings, to separate various areas of the building. For example, such sliding doors are conventionally provided for permitting closure of a doorway or access between a workspace and an access region such as a corridor. Since horizontal sliding doors will naturally remain in a closed position due to their supportive construction, the door is typically not provided with a latch, but rather is conventionally provided with stationary handles or pulls associated with the exterior and interior surfaces of the door. When locking or latching of the door is desired so as to provide a privacy or security feature, then the door is traditionally provided with a separate lock assembly of conventional construction, which assembly provides a latching bolt such as a typical swinging bolt which cooperates with a stationary latch element associated with the adjacent door frame. The lock assembly typically has a manually rotatable handle associated with the inside of the door to permit manual rotating of the locking bolt between locked and released positions, and also traditionally has a key assembly associated with the exterior side for permitting movement of the locking bolt between locked and unlocked positions. Such arrangement, however, when opening of the locked door from the inside surface thereof is desired, requires two separate motions or manual manipulations, the first being a manual rotary motion for effecting release of the lock, and the second being a manual linear pushing motion against the handle to effect opening of the sliding door. In an emergency situation, however, particularly when an individual is within the work space and has the door closed and locked, the double motion required to effect an emergency release and opening of the door so as to provide access to a corridor or exterior region can be unduly complex. There thus exists a need for a simplified handle-lock arrangement which permits both unlocking and opening of the sliding door from the inside surface thereof without requiring dual or different manual manipulations so as to effect the unlocking and opening of the door.

There also exists a need for a simplified handle-lock arrangement which permits unlocking and opening of a sliding door by persons of limited or restricted manual dexterity since many of the existing arrangements, and the multiple motions required to effect unlocking and opening of the sliding door, have proven unduly difficult to operate for such persons.

The present invention relates to a sliding door having an improved handle and lock assembly associated therewith, which assembly overcomes the aforementioned disadvantage by enabling a closed and locked sliding door to be unlocked and opened by manual application of a single-motion to the door handle, such as a substantially horizontally-directed force applied to the door handle in the opening direction so as to effect unlocking or unlatching of the door followed by movement of the sliding door into an open position.

The handle-lock assembly provided on a sliding door according to the present invention includes a single-motion door handle, typically disposed for swinging movement through a small angular extent, and coupled through a motion transfer device to a bolt member which is movably carried on the door, typically for sliding or pivoting movement, and when moved into a locked or latching position is engageable with a retainer structure fixed to an adjacent frame or jamb member to hold the door in a closed position. To effect unlocking and opening of the door, the handle is engaged and manually swingably moved through a small angle by application of a manual force thereto generally in the door opening direction, which handle movement acting through the motion transfer mechanism causes the bolt member to move into an unlocked or unlatched position relative to the adjacent frame or jamb. The continued application of manual force to the handle, upon release of the bolt member, then effects movement of the sliding door in its opening direction. The door unlocking and opening is hence controlled by basically a single force applied generally in the opening direction and applied to only a single activating member, such as a swingable handle.

In the handle-lock assembly of the invention, in one embodiment thereof, to effect closing of the door a manual force oriented in the door closing direction is applied to the handle, causing the handle to swing through a small arcuate extent, which is permitted due to lost motion provided in the motion transfer mechanisms such that the bolt member is not displaced, with continued application of said force on the handle in the closing direction then causing the door to move into a closed position. If latching or locking of the door in the closed position is desired, then the door on at least one side thereof (such as on the inside or privacy side) may be provided with a separate latching or locking actuator, such as a conventional thumb turn member interconnected to the bolt member such that turning of the thumb turn member through a typical arcuate extent, such as for example 90°, effects sliding or swinging movement of the bolt member into a position of engagement with the adjacent jamb or frame. The manual movement of the thumb turn member and the corresponding movement of the bolt member, however, do not effect the position of the main handle since the lost motion associated with the motion transfer mechanism permits the thumb turn member to effect the desired closing or locking movement of the bolt member without causing movement of the main handle.

In the present invention, according to one embodiment thereof, there is provided a sliding door which is supported, such as rollingly supported, on a horizontally elongate track which extends along one of the upper or lower edges of the door, typically the upper edge. The door has handles on opposite sides which can be manually gripped to permit opening and closing of the door. The door also has a lock mechanism associated therewith, and disposed in the vicinity of the handles. The lock mechanism includes a rotary cylinder which, through an appropriate motion converting mechanism of conventional construction, effects linear extending and contracting movement of an elongate lock bolt which is vertically slidably supported on the door and, when extended, projects from the edge thereof for locking engagement with the track (or header or floor) when the door is in the closed position. The lock mechanism has a manually actuated actuator (such as a thumb turn or push button) on the inner side thereof for effecting rotation of the lock cylinder during locking movement, and is also preferably provided with a key-activated cylinder on the outer side of the door for effecting locking and unlocking movement of the lock bolt. The handle on the inside of the door is a vertically elongate lever supported for pivoting movement about one end thereof, and is movable through an angular extent between first and second end positions which define a small angle therebetween, with the handle preferably remaining in a dominantly vertical orientation at all times. The pivot for the handle lever is coupled through a motion-transmitting mechanism to the lock cylinder so that, when the door is in a closed and locked position, movement of the handle from one end position to the opposite end position, due to application of a generally sidewardly oriented opening force and motion against one side of the handle, causes the lock to be rotated to retract the bolt. After the handle moves through the angular extent, the continued application of the sideward force against the side of the handle is effective for moving the door into the open position. The application of a single-direction force and motion against the handle is hence effective for initially unlocking the door and thereafter effecting movement thereof to the open position.

In the arrangement of the present invention, as aforesaid, the mechanism which couples the handle pivot to the lock cylinder preferably includes a lost-motion connection which, when the handle is swung back from the second end position to the first end position during closing of the door, permits the handle to be swingably displaced without effecting actuation of the lock. In the closed position of the door, the lock can then be individually selectively actuated, such as by manually applying an actuating force to the actuator associated with the lock cylinder.

In the arrangement of this invention, the activation of the lock into a locked position can be individually controlled and activated by the occupant of the workspace defined adjacent the inside surface of the door, when the door is in a closed position, so that activation of the lock is hence selective and independent from the movement of the handle during the door closing movement. However, opening of the sliding door, particularly in an emergency situation, can be effected by a single directional movement or force, namely the substantially horizontal sideward application of a manual force against the side of the vertically-elongate handle so as to cause the handle to initially move through a small angular extent to its opposite end position, which hence drives the lock cylinder to retract the lock bolt, with continued application of this sidewardly-directed force against the handle thereafter being effective to cause the door to be horizontally moved into its open position. Since the handle is vertically elongate and remains in a dominantly vertical orientation when in or during movement through the small angular extent between the two end positions, the swinging movement of the handle and the subsequent opening movement of the door can all be easily accomplished by the application of a generally sidewardly and substantially horizontally applied manual force-against one side of the handle.

In the arrangement of the present invention, the movement of the locking bolt, whether it be slidable or pivotal, is controlled by a rotary locking member or cylinder which, due to its rotary displacement from an unlocking position to a locking position, controls the disposition of the bolt so that the latter is in a locking position extending from the door. The rotary movement of the locking member or cylinder in one direction is controlled by the opening movement of the main door handle so as to automatically effect retracting movement of the bolt into its unlocked position to permit opening of the sliding door. Rotary movement of the locking member or cylinder in the opposite direction, however, so as to move the bolt into a locking position may be independent of the handle so as to be controlled by a separate actuator provided on the door, such as a thumb turn handle or a key cylinder. The bolt may be mounted for sliding movement on the door, such as adjacent either or both of the upper and lower edges thereof for cooperation with a header or the floor, or with appropriate rails or tracks which guide the upper and lower edges of the door, or may be swingably mounted on the door for cooperation with an adjacent vertical jamb or frame element when the door is in the closed position.

Other objects and purposes of the invention will be apparent to persons familiar with constructions of this type upon reading the following specification and inspecting the accompanying drawings.

BRIEF DESCRIPTION OF THE DRAWINGS

FIG. 4 is a fragmentary perspective view which illustrates solely part of the sliding door as appearing from the inside thereof.

FIG. 5 is a fragmentary perspective view of solely the sliding door as appearing from the other or outer side thereof.

Figure 1:
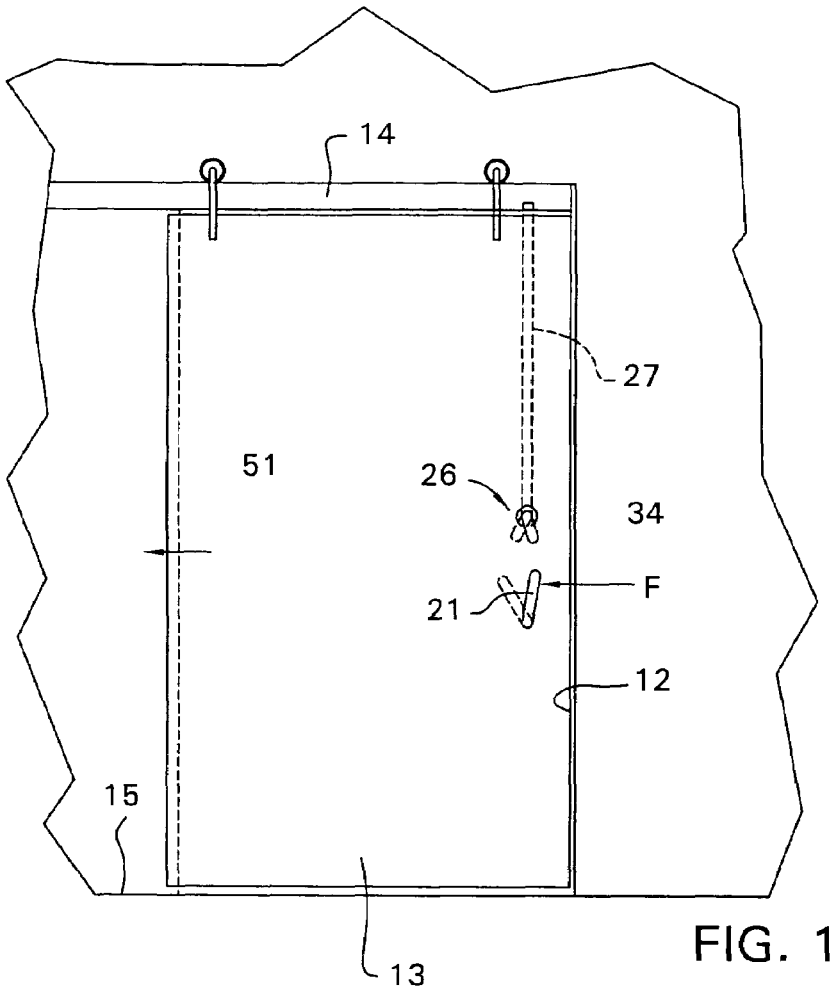
FIG. 1 is a diagrammatic elevational view showing a wall having a door opening therein and having a horizontally sliding door disposed for closing the opening, the door being in the closed position and shown from the inside surface thereof.

Certain terminology will be used in the following descriptions for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the door or designated parts of the door handle and locking mechanism. Said terminology will include the words specifically mentioned, derivatives thereof, and words of similar import.

DETAILED DESCRIPTION

Figure 3:
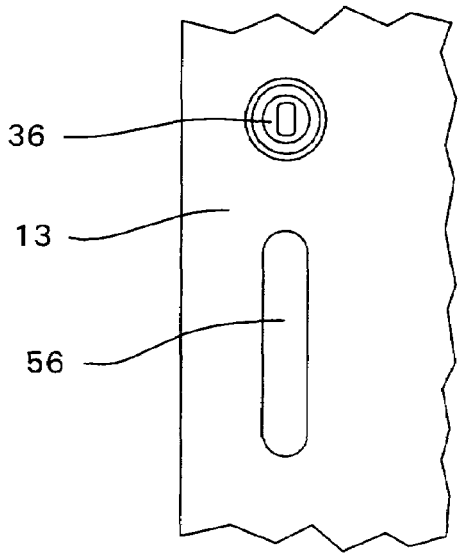
FIG. 3 is an enlarged fragmentary view which illustrates the handle and lock mechanism provided on the other or outer side of the sliding door.
Figure 2:
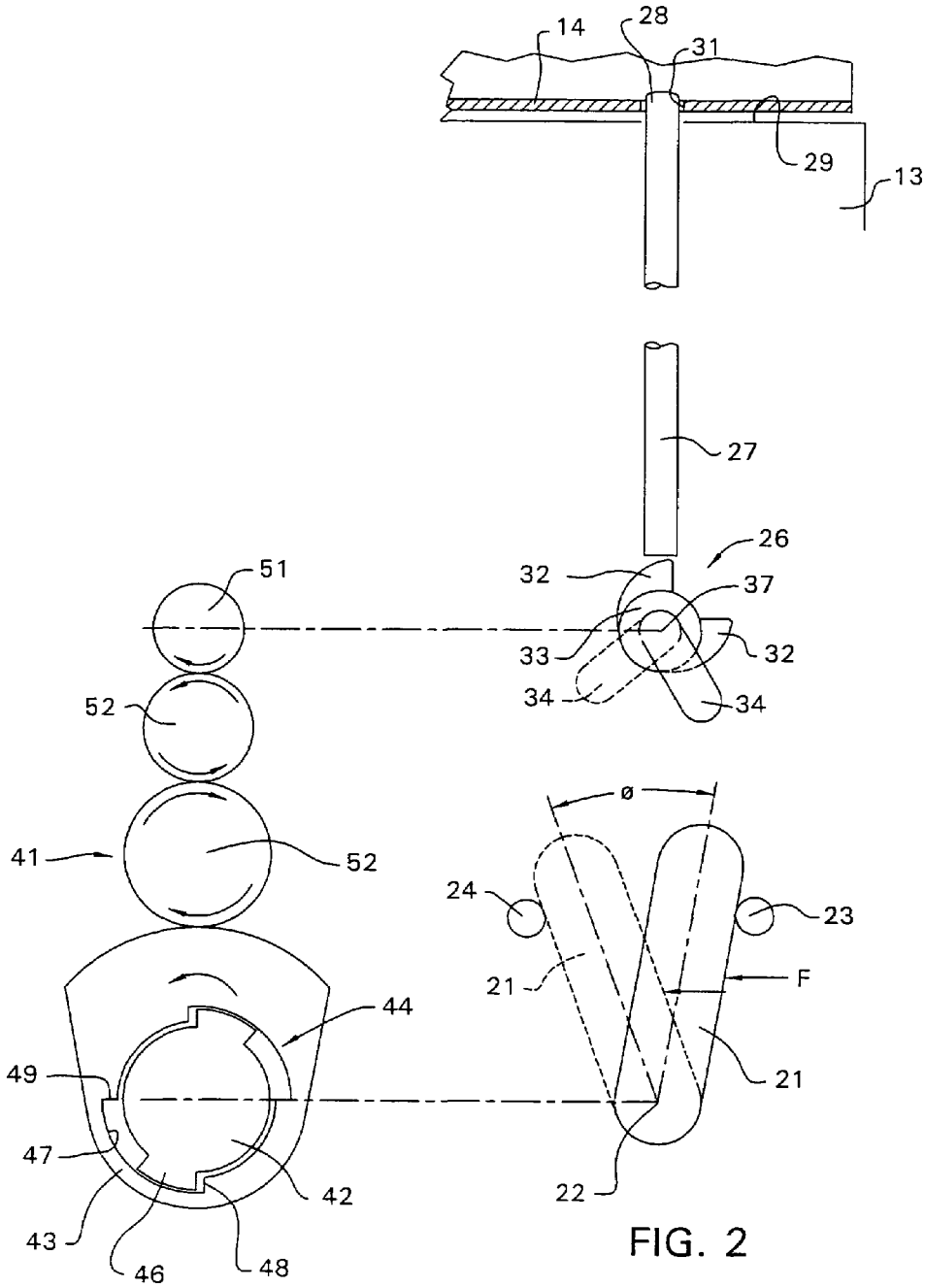
FIG. 2 is a diagrammatic exploded view which illustrates one embodiment of the handle and locking mechanism associated with the sliding door of this invention.

An embodiment of the invention will initially be described with respect to FIGS. 1–3.

Referring to FIG. 1, there is diagrammatically illustrated an upright wall structure 11 having a door-way or access opening 12 therein, such as for providing communication between an office or workspace on one side of the doorway, and a corridor or other access region on the opposite side of the doorway. An upright sliding door 13 is disposed for horizontal sliding movement adjacent the wall structure 11 so as to be movable between open and closed positions relative to the doorway 12. The door 13 in FIG. 1 is illustrated in the closed position.

The sliding door 13, as is conventional, is supported on a support track 14 which is stationarily supported and extends generally horizontally along one of the upper or lower edges of the sliding door, the track 14 in the illustrated embodiment being disposed adjacent the upper edge of the door so as to permit the door to be movably supported on and suspended from the tracks, such as by rollers, as is conventional. The door projects upwardly from and has the lower edge thereof in close vicinity to a horizontal surface such as a floor 15.

According to the present invention, the sliding door 13 has a handle 21 mounted on the door adjacent the inside surface thereof, which handle 21 in the present invention is preferably defined by a vertically elongate actuating lever which is oriented so as to always be dominantly vertically oriented, with the lever having a substantial length, such as at least several inches in length. The handle or actuating lever 21 is preferably supported at one end thereof for swinging movement relative to the sliding door about a substantially horizontal pivot axis 22 which transversely intersects the door. The pivot axis 22 in this illustrated embodiment is disposed adjacent the lower end of the actuating lever 21. The actuating lever 21 is positioned so as to be vertically swingable about the axis 22 through only a small arcuate extent, such as designated by the angle θ in FIG. 2. The actuating lever 21 cooperates with a stop structure, such as diagrammatically illustrated by stops 23 and 24 fixedly associated with the door, so that the handle can swingably move through only the small angular extent. When the actuating lever 21 is in either of the end positions illustrated by solid and dotted lines in FIGS. 1 and 2, or any position therebetween, the handle is elongated dominantly in a vertical orientation.

In the present invention, the angular displacement as defined by angle θ is typically small, preferably a maximum of about 45°, with this angular extent preferably being in the range of from about 15° to about 45°.

The sliding door 13 also mounts thereon a locking mechanism 26 which includes an elongate bolt 27 which is disposed to extend vertically along the sliding door, with the bolt being vertically slidable so as to move between extended (i.e. locking) and contracted (i.e. unlocking) positions. The bolt 27 in the illustrated embodiment projects upwardly so that the tip end 28 thereof can extend outwardly beyond the upper edge 29 of the door when in a locking position, whereby the tip end of the locking bolt is engageable within an opening or restraining structure 31 associated with the track or header 14 when the door is in a closed position so as to effect locking of the door in the closed position.

The locking mechanism 26 includes a suitable motion converting and controlling mechanism 32 which controls the vertical displacement of the locking bolt 27, which mechanism may comprise cams 32 or other suitable devices which cooperate with the bolt 27. The cams 32 in turn are associated with a rotary lock cylinder 33 which is rotatable about a horizontal axis 37 which extends generally transverse to the door and is spaced from but parallel with the pivot axis 22. The lock cylinder 33, on the end thereof which is exposed to the inside surface of the door, has a suitable actuating handle or lever 34 secured thereto, which handle 34 can be manually gripped from inside the door so as to be manually rotated to effect locking of the door.

The mechanism associated with the lock for converting the rotation of the lock cylinder 33 into linear movement of the locking bolt 27 is conventional, and is well known in numerous types of locking or latching structures associated with door handles or the like. Hence, many different conventional mechanisms can be utilized for converting the rotation of the lock cylinder into linear displacement of the lock bolt.

The door 13 is additionally provided, on the outer side thereof as shown in FIG. 3, with a conventional key-actuated mechanism 36 which also couples to the lock cylinder 33 so as to effect control over the rotary motion thereof. The key-actuated mechanism 36 can be manually rotated to effect rotation of the lock bolt 33, and hence locking or unlocking of the bolt, solely by insertion of an appropriate key into the mechanism 36, such as is conventional and well known.

To permit automatic release of the lock bolt 27 by the actuating lever or handle 21 during opening of the sliding door, the locking arrangement 26 of the present invention includes a motion transfer mechanism 41 which couples the activating lever 21 to the lock cylinder 33. This motion transfer mechanism, in the illustrated embodiment, includes a drive hub 42 which is fixed to the activating lever 21 and which defines the pivot axis 22. The driving hub 42 in turn can effect direct driving of a surrounding driving gear 43 (a gear sector in the drawing). The drive hub 42 and driving gear 43 are drivingly interconnected through a lost-motion driving connection 44 which permits only a limited angular extent of lost motion therebetween. For this purpose, and in the illustrated embodiment, the driving hub 42 has one or more driving shoulders 46 projecting radially outwardly thereof and disposed within elongate arcuate recesses 47 in the surrounding driving gear 43. These latter arcuate recesses 47 extend through an angular extent greater than that of the driving shoulders 46, and the recesses adjacent opposite ends thereof define shoulders 48 and 49. The arcuate recesses 47 are sufficiently elongated so as to permit relative motion between the hub 42 and driving gear 43 through an angular extent which substantially corresponds to the permissible angular motion of the activating lever 21, namely the angle θ.

Accordingly, when the activating lever or handle 21 is in one extreme position corresponding to the door being closed, as indicated by solid lines in FIG. 2, the shoulders 46 are disposed so that they substantially abut the shoulders 48 on the driving gear 43. Accordingly, when the activating lever 21 is angularly displaced through the angle θ by application of a force F thereto so as to cause the lever 21 to move into the opposite extreme position as indicated by dotted lines in FIG. 2, the rotation of the hub 42 and its abutting engagement with the shoulders 48 causes a corresponding angular rotation of the driving gear 43. This in turn, acting through appropriate intermediate gears 52, causes a rotation of a driven gear 51, the latter being coaxially aligned with and coupled to the lock cylinder 33 for rotation therewith. The rotation of the activating lever 21 away from the door closed position as indicated by solid lines in FIG. 2 thus, acting through the mechanism 41, causes a rotation of the lock cylinder 33 which causes it to rotate away from the locked position illustrated in FIG. 2 so as to effect withdrawal or retraction of the locking bolt 27 into its retracted or unlocking position.

Conversely, when the activating handle 21 is swingably moved backwardly from the dotted position of FIG. 2 into the solid line position, such as during closing of the door, then the reverse rotation of the hub 22 causes the shoulders 46 to move along the length of the arcuate recesses 47 until the shoulders 46 substantially contact the opposed shoulders 49. Upon reaching this latter position, the handle 21 has now traversed its permissible angular extent and substantially abuts against the stop 23.

To facilitate opening and closing of the door from the outer surface thereof, the door is also provided with a handle 56 secured to the other side thereof, which handle is separate from the key activated lock mechanism 36. The handle 56 may be fixedly mounted on the outer surface of the door and hence is not interconnected to and thus does not effect movement of the motion transfer mechanism 41.

The operation of the sliding door and specifically the relationship and operation of the handle and lock mechanism of FIGS. 1–3 will now be briefly summarized.

It will initially be assumed that the door is in a closed and locked position, as illustrated in FIG. 1 and as illustrated by solid lines in FIG. 2. In this position the lock bolt 27 is extended upwardly so that the end 28 thereof projects into the opening 31 associated with the stationary track 14. Further, the activating handle 21 is disposed at one extreme of its angular permissible movement, such as limited by a suitable stop structure 23, with the handle still being in a dominant vertical orientation.

To effect simplified opening of the closed and locked sliding door, particularly in an emergency situation, an occupant within the workspace defined adjacent the inside surface of the door can apply a simple unidirectional motion and force against the handle, such as indicated by the force F in FIG. 2. This force is supplied generally horizontally against one side of the handle, namely against the side which causes the force to point in the door opening direction. The manual application of this force F initially causes the handle 21 to rotate about axis 22 through the small angular extent θ until the handle reaches its other stop position as defined by stop 24. During this small angular swinging of the activating handle 21, the hub 42 is rotated and causes a corresponding rotation of the driving gear 43 which, acting through gears 52, causes rotation of driven gear 51 and lock cylinder 33 so that lock bolt 27 is moved vertically downwardly into a retracted or unlocked position. The continued application of the substantially horizontally and leftwardly directed force F against the side of the handle 21, when the handle is in the opening position as indicated by dotted lines in FIG. 2, now causes this force to be effective in moving the door horizontally into its open position, whereby the occupant can readily pass through the opened doorway.

With the above arrangement, a single directional motion and force, as illustrated by the force F, is hence effective to initially effect unlocking of the door, followed by automatic opening of the door, whereby a single manual application of motion and force along a single direction can be easily applied so as to permit quick and safe opening of the door, including opening by a person who is partially handicapped or incapacitated.

When the door is in the open position, then the activating handle 21 and the lock actuator 34 are in the dotted positions indicated in FIG. 2. Gripping of the activating handle 21 and application of a closing force thereto, namely a closing force which will be generally horizontally but rightwardly oriented in FIG. 2, is then effective for swinging the activating handle 21 through the angle θ into the solid line position indicated in FIG. 2. During this swinging movement of the handle 21, the hub 42 rotates but the shoulders 46 move through the arcuate recesses 47 until reaching a position adjacent the shoulders 49, whereby the driving gear 43 is hence not rotated, and thus the lock mechanism 26 remains in its retracted or unlocked position. When the handle 21 abuts against the stop 23, appropriate force can then be applied against the handle so as to effect closing of the door.

Once the door has reached its closed position, then if desired the occupant of the workspace defined adjacent the inside surface of the door can selectively activate the lock mechanism 26 if desired. In this case, the occupant grips and manually rotates the activating lever 34 from the dotted position of FIG. 2 into the solid line position, thereby causing the locking bolt 27 to be vertically displaced upwardly into its extended locking position. Similarly, in this illustrated arrangement the occupant can also readily unlock the mechanism 26 at any time merely by reversely rotating the activating handle 34 back to the unlocked position as indicated by dotted lines in FIG. 2.

With the door in the closed position, the door can also be locked from the exterior side thereof by inserting an appropriate key into the activating cylinder 36 to hence effect rotation of the lock cylinder 33 to cause extension of the locking bolt into its locking position.

Thus, in summary, with the arrangement of this invention, the closing movement of the door is controlled by a force applied to the handle 21 by a person to effect sliding movement of the door into its closed position. When the door is in the closed position, however, the person may then selectively lock the door if desired, which locking of the door is manually controlled by the person, independent of the handle 21, due to the person manually activating either the lock activating lever 34 or by key-activation of the lock cylinder. Use of the handle 21 is hence effective solely for closing the door, and locking of the door is accomplished wholly independently of the handle 21. In contrast, when the door is in its closed and locked position, the person can effect both unlocking and opening of the door from the inside surface thereof by a single manual manipulation, namely by applying a sideward pushing force against the handle 21 in the opening direction, which pushing force initially causes the handle to swing so as to effect unlocking of the lock mechanism, with the continued application of the pushing force against the handle 21 then effecting opening of the door. The opening of the closed and locked door by the person is hence controlled by a single function, in contrast to the two functions required by the person so as to effect closing and locking of the door.

In the present invention, the mechanism 41 which couples between the hub 42 for the activating handle 21 and the lock cylinder 33 is preferably designed so as to provide a mechanical advantage with respect to motion, that is, the mechanism preferably provides a greater angular output at the driven gear 51 than is inputted at the driving gear 43. This hence permits the activating handle 21 to move through a small angular extent, while at the same time providing a greater angular movement at the lock cylinder 33 so as to permit effective extending and contracting of the locking bolt 27. Solely as an example, while the angular displacement of the activating handle 21 will preferably be a maximum of about 45° and preferably less, it will likewise be appreciated that the angular movement of the lock cylinder 33 will more typically be in the range of 60° to 90° so as to effect the desired linear movement of the lock bolt, since mechanisms for effecting this latter motion are conventional and well known.

It will be further appreciated that numerous other types of known mechanisms can be provided for coupling the pivot hub 42 of the activating handle 21 to the lock cylinder 33 to effect the desired transfer of motion therebetween so as to effect release of the lock in response to opening movement of the activating handle 21.

In addition, the vertically elongated length of the activating handle 21, and the disposition of the pivot axis 22 at the end thereof, is desirable since this is believed to provide a more convenient positioning of the activating handle for engagement with an occupant's hand or arm so as to permit the horizontal swinging and displacement thereof during the sequential unlocking and opening of the sliding door. The activating handle 21 is preferably provided with appropriate surfaces on the opposite sides thereof to facilitate and optimize the ability to contact the sides of the handle and apply the generally horizontally directed opening force thereto, with this side surface being both shaped and sized so as to optimize the ability to conveniently and safely permit the application of the opening force thereto.

With the improved sliding door of the present invention and specifically the application of a handle and lock mechanism thereto as described above, the lock bolt is preferably disposed on the door so as to be slidably movable in a vertical direction, with the tip end of the locking bolt being positioned so as to project outwardly from either the upper or lower edge of the door, for example being engageable with either the track or header which is disposed adjacent the upper edge of the door, or being projectible from the lower edge of the door for engagement with a striker plate which can be provided on the floor under the lower edge of the door. The use of a vertically movable lock bolt is preferred since this mechanism hence can be used with not only doors which fit within a pocket and abut against a door jamb when in a closed position, but can also be used with sliding doors which are disposed adjacent the face of the wall and hence overlap the wall and the door opening, with the door in the closed position hence being disposed solely in overlapping relationship, whereby the door edge does not cooperate with a vertical door jamb. The vertical orientation of the locking bolt is also believed to facilitate the alignment and proper positioning of the lock bolt since doors of this type are conventionally utilized with prefabricated wall panels, and hence this orientation of the lock bolt is believed to be less influenced by overall building and assembly tolerances.

Several structural and operational variations of the operating and opening mechanism for a sliding door according to the present invention are illustrated in FIGS. 6–12, and will hereinafter be briefly described.

Figure 6:
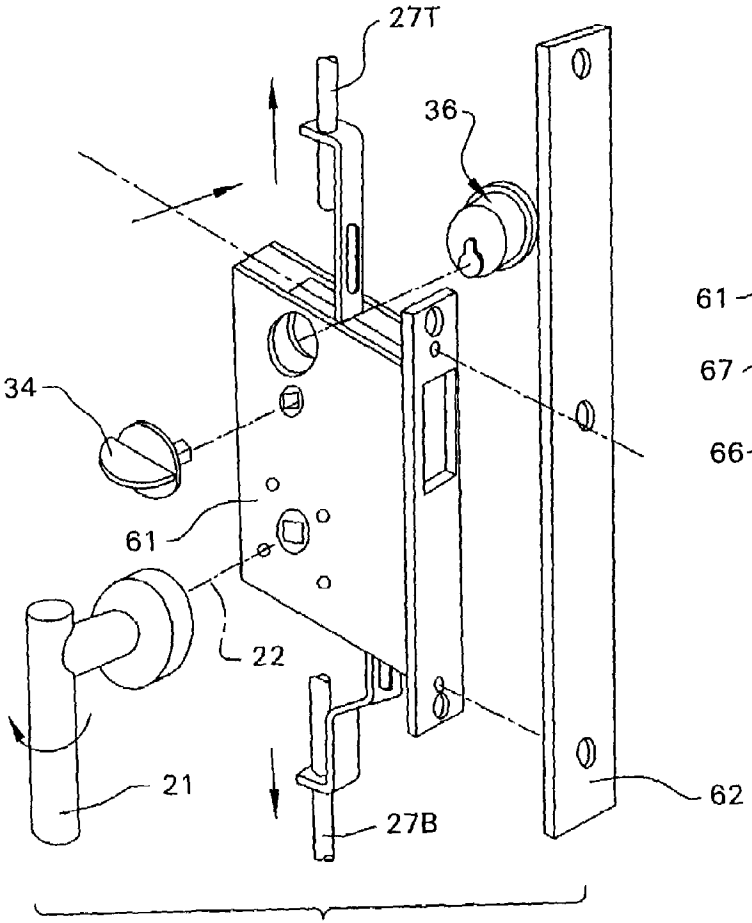
FIG. 6 is an exploded perspective view illustrating a variation of the arrangement depicted by FIGS. 1–3.

Referring initially to FIG. 6, the locking mechanism (for example the mechanism 26 of FIGS. 1–3) is disposed internally of a mortise lock housing 61 which in a conventional manner is fitted within the sliding door adjacent a vertical edge thereof, and the internal mechanism thereof cooperates with the main handle or actuating lever 21 and also cooperates with the locking handle (i.e., a conventional thumb turn handle 34 and a key cylinder 36) as accessible from opposite sides of the door. The handle or lever 21 in this illustrated embodiment is provided with its support pivot axis 22 associated with the upper end of the handle. The arrangement also has upper and lower sliding bolts designated respectively as 27T and 27B associated therewith and projecting respectively for cooperation with upper and lower edges of the door. Either or both of these bolts may be provided depending upon the number of action points desired. If both bolts are provided, then the rotary locking cylinder will be provided with dual cams or mechanisms associated therewith for permitting simultaneous extension and contraction of the two sliding bolts. A face plate 62 can be provided for securing the mortise lock housing 61 within the door. The arrangement illustrated by FIG. 6 operates in the same manner as the arrangement of FIGS. 1–3 as described above. However, since the handle in FIG. 6 swings in the opposite direction from the handle in FIG. 2, the motion converting mechanism connected between the handle and the lock bolt will be appropriately modified to compensate for this directional difference.

Figure 7:
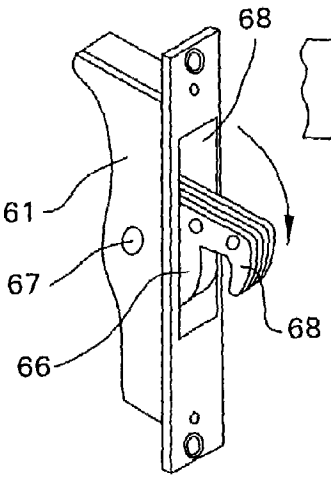
FIG. 7 illustrates a further variation employing a swinging lock bolt.

As illustrated by FIG. 7, the handle and locking arrangement can be provided with a swinging lock bolt 66 which in this illustrated arrangement is supported for swinging movement about a transverse horizontal axis 67. The bolt 66 at the projecting free end is provided with an appropriate hook 68, with this hooked end being extendible outwardly through an opening 69 formed in the edge face of the mortise lock housing when the bolt is in its locking position as illustrated. With this arrangement, and particularly when the upright edge of the door 13 abuts an upright stationary frame or jamb 72 as illustrated by FIGS. 8–9, the activation of the bolt into its locking position causes the hook 68 to project into a recess 71 formed in the jamb 72 to effect a locking of the door to the jamb.

Figure 9:
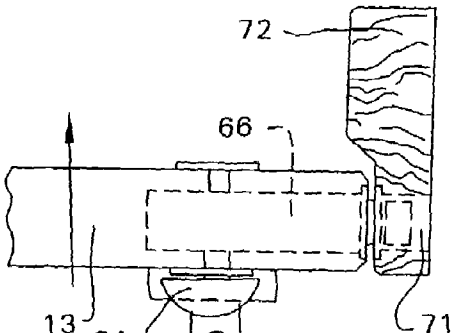
FIGS. 8 and 9 are respective fragmentary elevational and plan views which incorporate the swinging lock bolt of FIG. 7 and illustrate the manner in which the edge of the sliding door, in a closed position, cooperates with a stationary door jamb.
Figure 8:
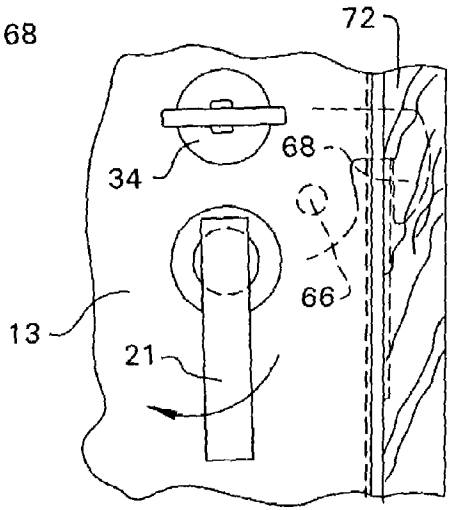

In the arrangement of FIGS. 7–9, the swinging bolt 66 is coupled to the rotary locking member or cylinder disposed interiorly of the housing 61 so that the rotary motion of the locking member caused by the thumb turn 34 or key cylinder 36, or the reverse rotary movement thereof caused by the opening movement of the handle 21, causes a corresponding locking or unlocking movement of the swingable bolt 66.

While the arrangement illustrated by FIGS. 7–9 may rely solely on use of a swinging lock bolt, it will be appreciated that the swinging lock bolt can also be used in conjunction with the vertically sliding lock bolts such as 27T and/or 27B of FIG. 6, so as to provide multiple and different locking points.

Figures 10, 11, 12, 18, 19:
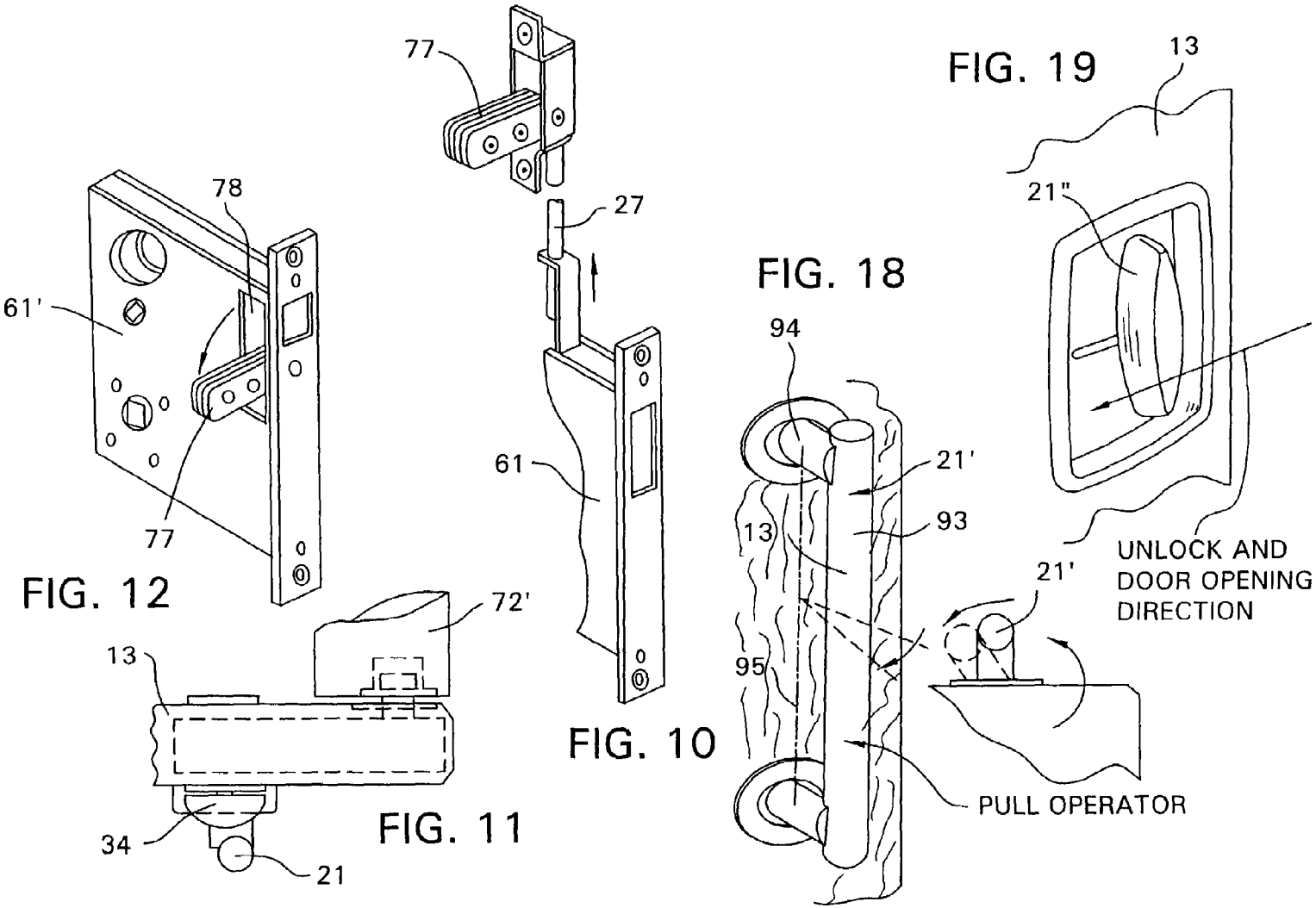
FIG. 10 is an exploded perspective view illustrating a further variation employing a combined sliding-pivoting locking bolt.
FIG. 11 is a fragmentary plan view illustrating the manner in which the bolt of FIG. 10 cooperates with a door jamb when the door is in a closed position wherein it overlaps or bypasses the jamb.
FIG. 12 illustrates a further variation wherein a pivoting locking bolt similar to FIG. 10 is employed but is associated directly with the mortise lock housing.
FIG. 18 illustrates a still further variation wherein the activating handle is formed as a lever supported on the sliding door for pivoting about a vertical axis.
FIG. 19 illustrates another variation wherein the actuating handle comprises a paddle which is horizontally slidably supported on the sliding door.

FIGS. 10–11 illustrate a further variation wherein the vertically slidable locking bolt as illustrated in FIG. 6 is provided but, rather than directly acting as the locking member, the locking member 27 in FIG. 10 is part of a multiple element locking bolt which includes a swinging locking bolt 77 coupled to the remote end of the vertical sliding bolt 27. The swinging bolt 77 is supported for swinging movement about a generally horizontal axis and is supported by a housing 76 fixedly carried on the door, which housing has the upper end of the bolt 27 slidably supported therein. The upper end of sliding bolt 27 is coupled to swinging bolt 77, such as through a pivotal connection having limited lost motion and spaced away from the main pivot axis so that when bolt 27 is driven upwardly, it causes a corresponding downward swinging of bolt 77 from an upright non-locking position into a generally horizontally projecting locking position substantially as illustrated. The swinging of the bolt 77 also occurs about an axis which extends parallel to the door movement, whereby the swinging of bolt 77 hence occurs in a sideward or transverse direction so that the latch bolt can move into engagement into a recess defined in the face of a jamb or frame 72', the latter being positioned so that the door 13 in the closed position overlaps or bypasses the jamb 72'.

While the arrangement illustrated by FIGS. 10–11 utilizes a vertically slidable bolt 27 for controlling the pivoting bolt 77, whereby the pivoting bolt 77 can be disposed for cooperation with a suitable jamb at any desired elevation relative to the door, there can also be provided a transverse swinging bolt 77 as illustrated in FIG. 12 which is mounted on and provided generally at the elevation of the mortise lock housing 61'. In this situation, the swinging movement of the bolt 77 between an upward retracted position and a downward projecting position (as illustrated) is controlled by a suitable motion transmitting linkage connected between the inner end of the swinging bolt 77 and the rotating locking member or cylinder such that all of the motion transfer mechanism is hence confined compactly within the interior of the mortise lock housing 61'. The cooperation of the swinging bolt 77 in FIG. 12 with an adjacent jamb is the same as illustrated by FIG. 11.

Referring now to FIGS. 13–17, there is illustrated variations for the configuration of the main actuating handle 21 used for controlling movement of the lock bolt.

Figure 14:
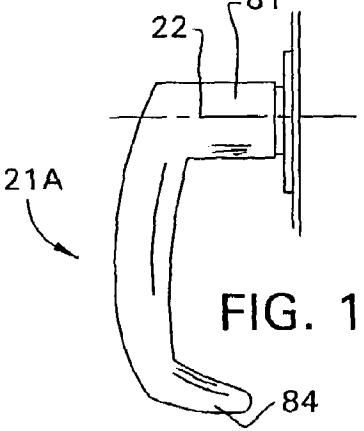
FIG. 14 is a side elevational view of the handle variation illustrated in FIG. 13.
Figure 13:
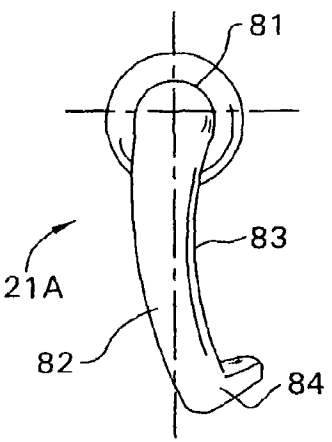
FIG. 13 is a front view which illustrates a variation of the configuration for the actuating handle.
Figure 15:
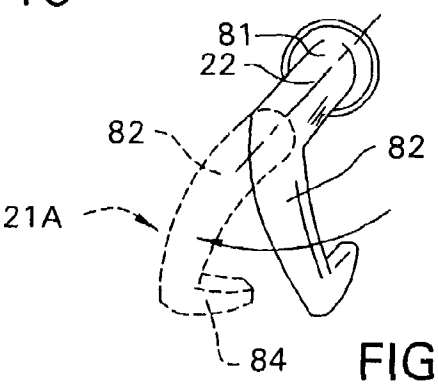
FIG. 15 is a perspective view showing the handle of FIGS. 13 and 14 in its extreme positions of movement.

More specifically, a modified actuating handle 21A is illustrated in FIGS. 13–15, which handle 21A at one end has a hub portion 81 which projects outwardly from the door so as to support the handle for swinging movement about the substantially horizontal axis 22 which projects transversely with respect to the door. The handle 21A has a main elongate handle part 82 which projects dominantly vertically (downwardly from the axis 22 in the illustrated embodiment) and which is provided with a gentle curvature when the handle is viewed from the front side thereof as appearing in FIG. 13. This curvature defines a generally shallow concave curvature 83 along the side of the handle which is contacted when the handle is to be rotated so as to release the latch bolt, as diagrammatically depicted in FIG. 15. The lower end of the main handle part 82 joins to a small end return 84 which cantilevers slightly inwardly toward the door and which defines the lower free end of the handle 21A. The configuration of the handle 21A, and specifically the shape of the main handle part 83 and the lower end return 84, is such that the handle has a hooklike configuration both when viewed transverse to the door as appearing in FIG. 14, but also when viewed perpendicular to the door as viewed in FIG. 13. This hooklike configuration of the handle and the shallow concave surface 83 provided on one side thereof hence greatly facilitates the ability to apply a pushing force to the side surface 83 of the handle so as to effect swinging movement of the handle in the door opening direction, without having to effect total manual grasping of the handle, and at the same time this hooklike configuration provides a side contact surface which results in part of the surface always being more closely vertically oriented as the handle undergoes swinging movement during door unlocking and opening, thereby permitting the angular swinging movement of the handle during the door unlocking and opening operation to be of greater angular extent while still maintaining a handle contact surface which more closely approaches a vertical orientation so as to permit contact between the handle and the operator's hand to be maintained.

Figure 17:
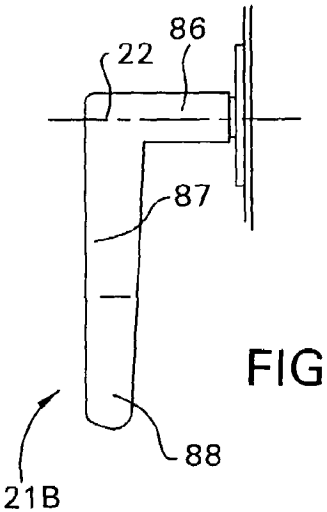
FIG. 17 is a side elevational view of the handle variation shown in FIG. 16.
Figure 16:
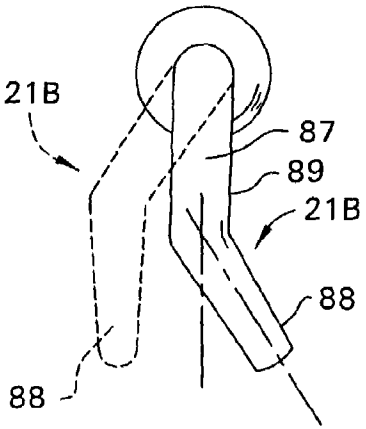
FIG. 16 is a front view illustrating a further variation of the configuration for the actuating handle.

A further modified handle configuration 21B is illustrated in FIGS. 16–17. This modified handle 21B again includes a hub part 86 at one end which defines the transverse rotational axis 22 for the handle, with the handle projecting downwardly dominantly vertically away from the axis 22. The handle 21B includes an upper handle part 87 which is generally straight and elongated downwardly from the axis 22, and this upper handle part 87 joins to a lower handle part 88 which is elongated downwardly from the lower end of the upper handle part 87. This lower handle part 88 terminates in a lower free end. The upper and lower handle parts 87 and 88, however, are elongated in angled relationship to one another, that is, the lower handle part 88 as diagrammatically illustrated by its longitudinally extending centerline 91 extends downwardly away from the upper handle part 87 by a small acute angle as defined relative to the longitudinally extending centerline 92 of the upper handle part. The overall handle defined by the parts 87–88 hence has a very shallow V-shaped configuration, whereby the inner side surface 89 of this configuration defines a shallow concave surface which is preferably slightly rounded where the upper and lower handle parts merge. This surface 89 is contacted by the operator when rotational movement of the handle is desired so as to effect unlocking and opening of the door. The unlocked position is depicted by dotted lines in FIG. 16.

With the handle configuration of FIGS. 16–17, the upper handle part 87 provides a generally vertically extending handle portion when in the locked position, whereas the lower portion 88 extends at a slight angle away from the vertical. During swinging of the handle into the door open position as indicated by dotted lines in FIG. 16, however, the upper part 87 begins to move slightly away from vertical, whereas the lower part 88 swings into a position wherein it is generally vertical when the handle reaches its open position. Accordingly, throughout the angular swinging of the handle between its extreme positions as illustrated by FIG. 16, the inner contact surface 89 of the handle always has a surface area which is either at or remains closely vertical. This arrangement, coupled with the concave curvature of this surface, facilitates the pushing contact of an occupant's hand against the handle, and at the same time enables the angular displacement of the handle between the door closed and door open positions to be maximized.

In place of an actuating handle swingably supported on the sliding door for movement about a horizontal axis as described above, the actuating handle may comprise a lever which is supported on the sliding door for swinging movement about a generally vertical axis, as illustrated by FIG. 18. In this variation, the actuating handle 21' is supported in spaced relationship from the face of the sliding door and comprises an elongate grip bar 93 which is oriented generally vertically and which, at opposite ends, has mounting parts 94 which protrude inwardly and are appropriately supported by pivots or bearings so that the handle 21' is swingable relative to the sliding door about a generally vertical pivot axis 95. One of the protruding handle pivot parts 94, at a location spaced from the pivot axis 95, can have a protruding part which engages with the motion conversion mechanism, such as for example within a lost-motion type opening or slot associated with the member 43 of FIG. 2 so that pivoting of the handle 21' about the axis 95 provides the same type of motion of member 43, including lost motion in the door closing direction, so as to control the locking bolt in the same manner as achieved by the swinging of handle 21 as described above relative to FIGS. 1–3.

With the handle arrangement 21' of FIG. 18, the horizontal swinging movement of the handle 21' about axis 95 when moving between locked and unlocked positions will again be of small angular extent, typically 30° or less, with this angular movement occurring at or about a position where the handle protrudes generally perpendicularly outwardly from the surface of the door.

As a further variation of a moving actuating handle is shown in FIG. 19 wherein there is illustrated a slidable actuating handle 21" which can be utilized to activate the locking mechanism. This handle 21" protrudes outwardly from the face of the sliding door and is mounted for horizontal sliding movement on the door through a limited stroke or distance. In this regard, the actuating handle 21" can be provided with an inwardly protruding pin which is guided within a horizontally elongated slot formed within the door for limiting the movement of the activating pin associated with the actuating handle. This pin can be positioned so as to cooperate with an enlarged slot or opening associated with the member 43 of FIG. 3 so as to permit the necessary lost motion while at the same time controlling the necessary rotational movement to effect locking and unlocking of the lock bolt in the same manner as described above.

Figure 21:
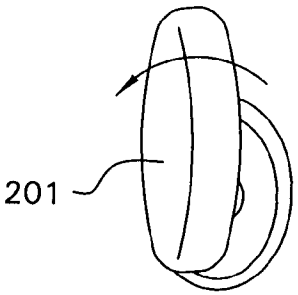
FIG. 21 illustrates a variation wherein a push button is used as a replacement for the conventional lock thumb turn.
Figure 22:
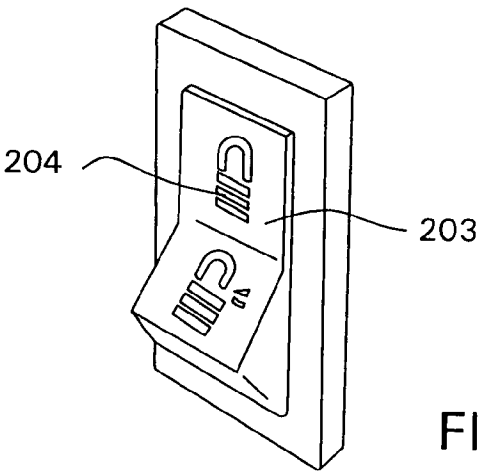
FIG. 22 illustrates a still further variation wherein a toggle replaces the conventional lock thumb turn.
Figure 20:
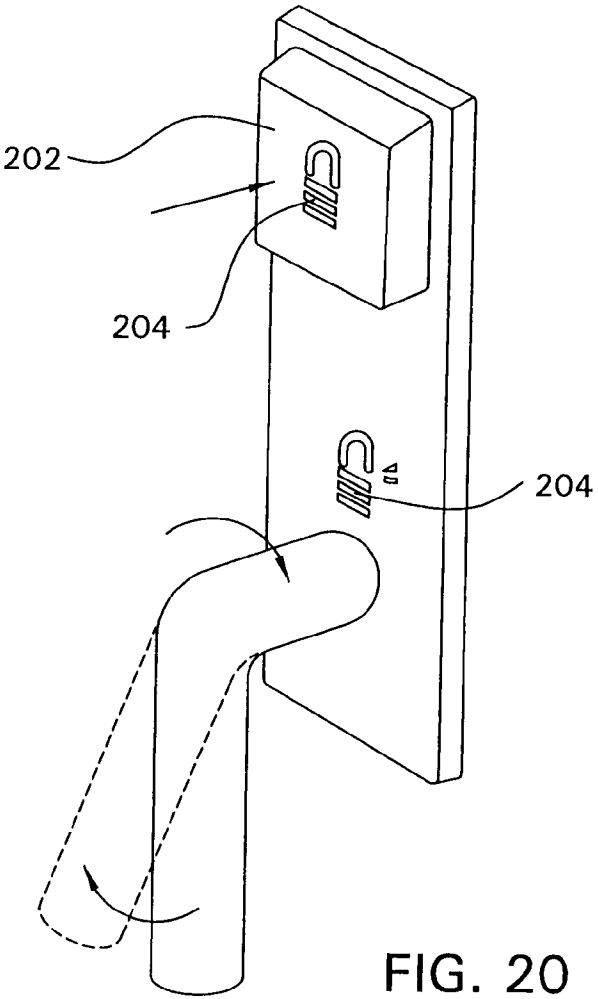
FIG. 20 illustrates a variation wherein the lock thumb turn is formed as an elongate paddle.

While the embodiments of the invention as described above have illustrated a conventional thumb turn 34 for permitting manual control of the lock from adjacent the inside surface of the door, it will be appreciated that the lock thumb turn 34 can be replaced by other conventional constructions. For example, the thumb turn can be replaced by an elongate paddle 201 as shown in FIG. 21, the latter in effect being an elongate lever which adjacent one end is connected to the rotatable lock shaft and hence functions in the same manner as a thumb turn. The elongate paddle 201 allows for rotation, such as through a maximum angle of 90°, without requiring tight grasping of the paddle. As a further alternative, the thumb turn can be replaced by a spring-biased push button 202 as illustrated in FIG. 20, which push button when manually depressed inwardly against the urging of the spring acts through an appropriate slide or cam mechanism so as to effect movement of the locking cam into a locking position which holds the locking bolt in its latching position. As a further alternative, and as illustrated in FIG. 22, the thumb turn can be replaced by a manually-removable toggle switch 203 which appropriately effects locking and unlocking of the lock mechanism. If desired, as indicated in FIGS. 20 and 22, icons 204 denoting utility and status can be provided.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An openable and closable sliding door arrangement for a doorway, comprising:

an upright door positioned for generally horizontal and rectilinear sliding movement between opened and closed positions relative to an upright doorway defined by a stationary structure, said door defining inside and outside surfaces on opposite sides thereof;

a locking mechanism supported on the door for movement between locking and unlocking positions, said locking mechanism including a locking member supported on the door for pivoting movement about a generally horizontal axis which extends transverse to the door, and a locking bolt arrangement which cooperates with and is movably displaced into a locking position in response to pivoting of the locking member from said unlocking position to said locking position, said locking bolt arrangement having an end portion which projects outwardly beyond the door when in said locking position for engagement with an adjacent retainer structure which is fixed to the stationary structure when the door is in the closed position;

a manually accessible and moveable lock actuator mounted on said door adjacent said inside surface thereof and interconnected to said locking member for permitting manual pivoting thereof into the locking position; and a manually accessible inner activating handle adjacent said inside surface in the vicinity of, but independent of, said lock actuator for controlling opening and closing sliding movement of said door, said inner activating handle being movably supported on said door for movement through a small generally horizontal distance in a direction generally parallel with the opening and closing directional movement of the door, and a motion transfer mechanism connected between the inner activating handle and the locking member so that manual movement of the inner activating handle relative to the door in the door-opening direction initially causes pivoting movement of the locking member to effect release of the locking bolt arrangement with continued application of a generally horizontally oriented opening force to the inner activating handle in the door opening direction thereafter causing opening movement of the door, and wherein manual movement of the inner activating handle relative to the door in the door-closing direction is incapable of effecting movement of the locking bolt into said locking position.

2. A door arrangement according to claim 1, wherein the locking bolt arrangement includes a vertically elongate bolt member which is vertically slidably supported on the door and has an end portion which, when the bolt member is in a locking position, projects vertically beyond one of the upper and lower edges of the door for engagement with the fixed retainer.

3. A door arrangement according to claim 1, wherein the locking bolt arrangement includes a first bolt member which is acted on by the locking member and is vertically movably supported within the door and which in turn movably couples to a second bolt member which is pivotally supported on the door and has an end portion which projects outwardly from the door for engagement with the fixed retainer when in the locked position.

4. A door arrangement according to claim 1, wherein the locking bolt arrangement includes a lock bolt member supported on the door for pivoting movement and having an end portion which projects outwardly of the door for engagement with the fixed retainer when in said locking position.

5. A door arrangement according to claim 1, wherein said inner activating handle is a vertically elongate lever which adjacent one end thereof is pivotally supported on the door for swinging movement about an axis which extends substantially transverse with respect to the inside surface of the door, said inner activating handle being swingable through a small angular extent between first and second positions which define locking and unlocking positions so that swinging movement of said handle between said positions in response to application of a horizontal force thereto causes the lever movement to be predominantly horizontal and generally parallel to the door opening and closing direction.

6. A door arrangement according to claim 5, wherein the activating handle is movable through an angle of no more than about 30°.

7. A door arrangement according to claim 1, including a key-activated actuator mounted adjacent the outside surface of the door and interconnected to the locking member for effecting rotation thereof in either direction into the respective locking and unlocking positions.

8. A door arrangement according to claim 7, including a manually accessible outer handle fixed to said door and accessible from the outside surface thereof, said outer handle being incapable of effecting engagement or release of the locking mechanism.

9. An openable and closable door arrangement for a doorway, comprising:

an upright sliding door positioned for generally solely horizontal movement between opened and closed positions relative to a doorway, said door being supported on a generally horizontally elongated track which extends substantially parallel to one of the horizontally-extending upper and lower edges of the door;

an activating handle mounted on the door and manually accessible from solely one side thereof for controlling opening and closing movement of the door, said activating handle comprising a vertically elongate activating lever which adjacent one end thereof is pivotally supported on said door for vertical swinging movement about a first substantially horizontal pivot axis which extends transverse to the door, said activating lever being angularly swingably moveable solely through a small angular extent as defined between first and second end positions, said activating lever having a significant vertical orientation when in either of said end positions or at any position therebetween;

a locking mechanism supported on said door in the vicinity of said activating handle and including a rotary locking member rotatably supported on the door for pivoting movement about a horizontal axis which extends transverse to the door, said locking mechanism including a vertically elongate locking bolt supported on the door for vertical sliding movement and which is interconnected to and is vertically displaced into a locking position in response to rotation of the rotary locking member, said locking bolt having an end portion which projects outwardly beyond the door for engagement with an adjacent stationary structure when the door is closed and the locking bolt is in the locking position;

a manually moveable actuator disposed adjacent and accessible from solely said one side of the door and inter-connected to the locking mechanism to effect manual locking of the locking bolt; and a motion transfer mechanism connected between a rotary hub of said activating handle and said locking mechanism for effecting rotation of the locking member in a release direction and to effect unlocking of the locking bolt in response to application of a manually-applied generally sidewardly-directed horizontally oriented opening force against said activating handle so as to effect swinging of the activating handle from one end position into the other end position to cause retraction of the locking bolt with the continued application of said opening force to said activating handle thereafter effecting opening of the sliding door;

whereby application of a single direction opening force and motion against the activating handle is effective for initially unlocking and thereafter effecting opening of the sliding door, and whereby application of a single direction closing force and motion against the activating handle is incapable of effecting movement of the locking bolt into the locking position.

10. A door arrangement according to claim 8, wherein the actuator for the rotary locking member comprises a manually rotatable actuator knob or lever which is coupled to said locking member and is disposed adjacent and accessible solely from said one side of the door.

11. A door arrangement according to claim 10, including a key-activated actuating member which is accessible solely from adjacent the other side of the door for effecting rotation of the locking member to effect locking or unlocking of the locking bolt from said other side of said door solely by insertion of a key into said key-activated actuating member.

12. A door arrangement according to claim 11, wherein a second handle is nonmovably fixedly secured to the other side of the door, said second handle being incapable of effecting release of the lock mechanism from its locked position.

13. A door arrangement according to claim 11, wherein the actuator comprises a manually rotatable actuator knob or lever which is coupled to said locking member and is disposed adjacent and accessible solely from said one side surface of the door to effect movement of the locking mechanism into the locking position, said actuator being disposed adjacent but separate of said activating handle.

14. A door arrangement according to claim 10, wherein said activating lever is movable through an angle of no more than about 45°, and wherein the rotary locking member is rotatable through a significantly greater angle in effecting movement of the locking bolt between locking and unlocking positions.

15. An openable and closable door arrangement for a doorway, comprising:

an upright sliding door positioned for generally solely horizontal movement between opened and closed positions relative to a doorway;

an activating handle mounted on one side of the door for controlling opening and closing movement thereof, said activating handle comprising an elongate activating lever which is pivotally supported on said door for vertical swinging movement about a first substantially horizontal pivot axis which extends transverse to the door, said activating lever being angularly swingably moveable through only a small angular extent as defined between first and second end positions, said activating lever having a significant vertical orientation when in either of said end positions or at any position therebetween;

a locking mechanism supported on said door in the vicinity of said activating handle and including a vertically elongate locking bolt, supported on the door for vertical sliding movement, said locking bolt having an end portion which projects outwardly beyond the door for engagement with an adjacent stationary structure when the door is closed and the locking bolt is in a locking position;

a manually accessible and manually moveable actuator disposed adjacent said one side of the door and interconnected to said locking mechanism for permitting manual movement thereof to effect locking of the locking bolt from said one side of said door; and a motion transfer mechanism connected between said activating lever and said locking mechanism to effect unlocking of the locking bolt in response to application of a manually-applied generally sidewardly-directed horizontally oriented opening force against said activating handle so as to effect swinging of the activating handle from one end position into the other end position to cause retraction of the locking bolt with the continued application of said opening force to said activating handle thereafter effecting opening of the sliding door;

wherein application of a single direction opening force and motion against solely the activating handle by a person positioned adjacent said one side of said door is effective for initially unlocking the locking mechanism and thereafter effecting opening of the sliding door, and wherein application of a closing force and motion against the activating handle by a person positioned adjacent said one side of said door is effective solely for closing but not locking said sliding door.

16. A door arrangement according to claim 15, including a key-activated actuating member which is accessible solely from adjacent the other side of the door for effecting solely locking or unlocking of the locking bolt from said other side of said door.

17. A door arrangement according to claim 16, including a second handle fixedly mounted on said door and manually accessible only from the other side thereof, said second handle being independent of said activating handle and incapable of effecting engagement or release of said locking mechanism.

18. An openable and closable door arrangement for a doorway, comprising:

an upright sliding door positioned for generally solely horizontal and rectilinear movement between opened and closed positions relative to a doorway, the door defining inside and outside surfaces on opposite sides thereof;

an activating handle mounted on the door adjacent the inside surface thereof for controlling the horizontal opening and closing rectilinear movement of the door, said activating handle being movably supported on said door for movement through a small horizontal extent as defined between first and second end positions;

a locking mechanism supported on said door in the vicinity of said activating handle and including a locking member supported on the door for movement between a retracted position and a locking position wherein an end portion of the locking member projects outwardly beyond an edge of the door for engagement with an adjacent stationary structure when the door is closed;

a manually accessible actuator mounted on the door adjacent the inside surface thereof and interconnected to the locking member for permitting manual movement thereof into said locking position; and a motion transfer mechanism connected between the activating handle and said locking mechanism for effecting movement of the locking member in a release direction to effect unlocking of the locking member in response to application of a manually-applied generally sidewardly-directed horizontally oriented opening force against said activating handle so as to effect movement of the activating handle from said first end position into said second end position to cause retraction of the locking member with the, continued application of said opening force to said actuating handle thereafter effecting horizontal opening of the sliding door;

wherein application of a single direction opening force and motion against the activating handle is effective for initially unlocking and thereafter effecting opening of the sliding door, and wherein application of a single direction closing force and motion against said activating handle is incapable of effecting locking of the sliding door.

19. A door arrangement according to claim 18, including a key-activated actuating member accessible solely from adjacent the outer surface of the door for effecting movement of the locking member to effect either locking or unlocking of the locking member.

20. A door arrangement according to claim 18, including a second handle fixedly mounted on said door and manually accessible only from the other side thereof, said second handle being independent of said activating handle and incapable of effecting engagement or release of said locking mechanism.

21. A door arrangement according to claim 18, wherein the motion transfer mechanism includes a lost motion connection which enables the activating handle to move from said second end position into said first end position in response to application of the closing force and motion to the activating handle without effecting engagement of the locking mechanism.

* * * * *